United States Patent [19]

Martinez

[11] Patent Number: 4,634,129

[45] Date of Patent: Jan. 6, 1987

[54] COLOR CORRELATED GAME BOARD AND PLAYING PIECES

[75] Inventor: Jorge Martinez, New York, N.Y.

[73] Assignee: Hugo Roman, New York, N.Y.

[21] Appl. No.: 644,851

[22] Filed: Aug. 27, 1984

[51] Int. Cl.[4] ..... A63F 3/00

[52] U.S. Cl. ..... 273/255; 273/288; 273/258; 273/146; 273/287

[58] Field of Search ..... 273/258, 248, 260, 261, 273/236, 243, 287, 242, 255

[56] References Cited

U.S. PATENT DOCUMENTS

| | | | |
|---|---|---|---|
| 817,233 | 4/1906 | Emmerling | 273/260 |
| 1,204,006 | 11/1916 | Goldmerstein | 273/291 |
| 1,474,504 | 11/1923 | Allen | 273/260 |
| 1,480,360 | 1/1924 | Agee, Jr. | 273/249 |
| 3,810,626 | 5/1974 | Eberle | 273/261 |
| 4,335,879 | 6/1982 | Wiskur | 273/260 |
| 4,391,449 | 7/1983 | Johnson | 273/260 |
| 4,489,947 | 12/1984 | Nolan | 273/271 |

*Primary Examiner*—Richard C. Pinkham
*Assistant Examiner*—Matthew L. Schneider
*Attorney, Agent, or Firm*—James J. Romano, Jr.

[57] ABSTRACT

A board game is provided and includes a checker-like game board having a plurality of rows of differently colored playing spaces. Differently colored playing pieces, both of a single color, and two colors, are positionable on the playing spaces in accordance with playing space-playing piece color coincidence. For adult play, movement of the playing pieces to like-colored playing spaces on the opponent's side of the game board is accomplished by playing piece movement, and jumping of the opponent's playing pieces; with the single colored playing pieces having greater freedom of movement in the manner of "kings" in checkers. For play by children, movement of the playing pieces to like-colored playing spaces on the opponent's side of the game board is accomplished by playing piece movement in accordance with sequential "throws" of multi-colored cubes.

14 Claims, 9 Drawing Figures

FIG.2
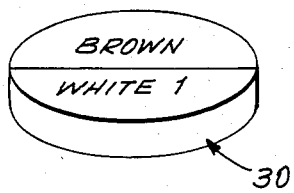
FIG.3
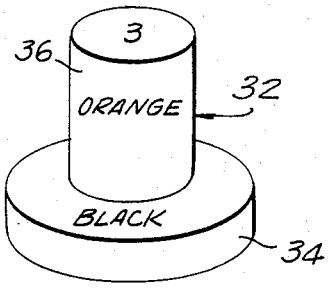
FIG.4
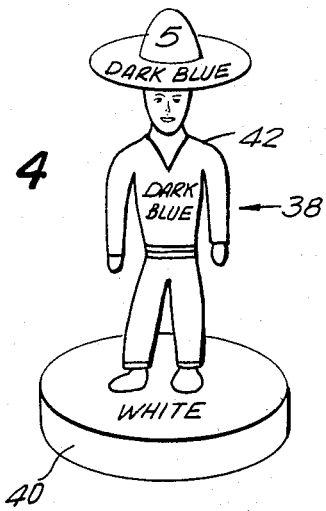
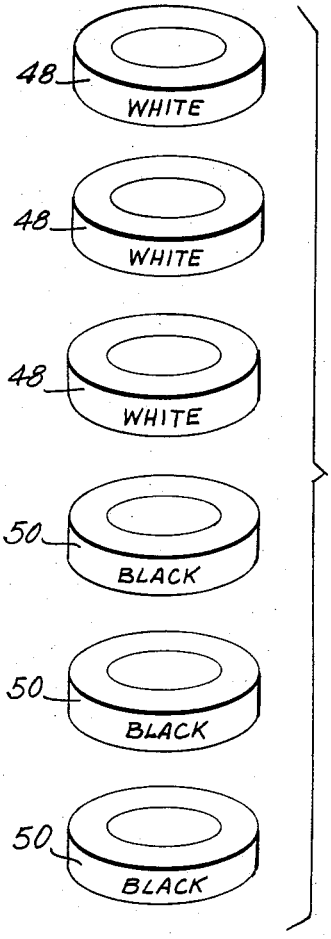
FIG.7
FIG.5
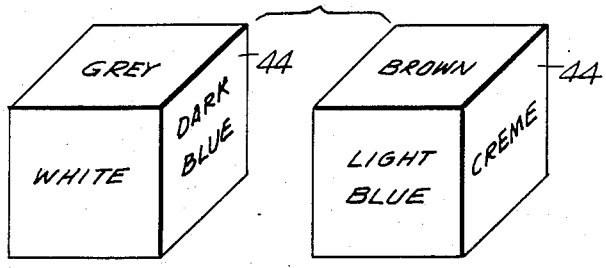
FIG.6
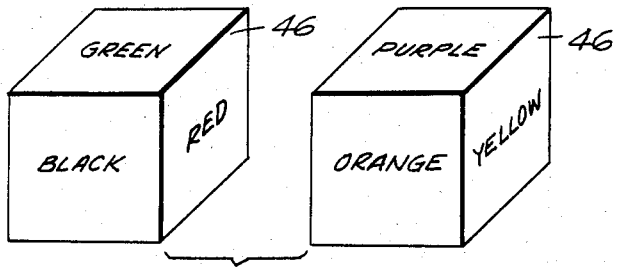

COLOR CORRELATED GAME BOARD AND PLAYING PIECES

BACKGROUND OF THE INVENTION

1. Field of The Invention

This invention relates to a new and improved board game, and methods of game play, which make correlated, particularly ingenious, challenging and/or educational use of a variety of different colors in conjunction with the game board, the game playing pieces, and the methods of game play; and which provide for different methods of game play commensurate with the different intellectual and/or skill levels of the game players.

2. Description of the prior art

Although board games which utilize different colors in conjunction with the game board, the game playing pieces, and/or the method of game play are known in the prior art, none are known which accomplish the same in the manners taught by the game of this invention or which, in conjunction therewith, provide for different methods of game play commensurate with different intellectual and/or skill levels of the game players.

More specifically, although the game disclosed in U.S. Pat. No. 3,408,073 to P. Suvada makes use of a variety of different colors, this use is limited to the substitution of different colors for the more traditional different shapes of the respective King, Queen, Bishop, Knight and Rook pieces of a chess game (the Pawns are "colorless"), and otherwise includes a conventionally checkered chess game board.

U.S. Pat. No. 1,772,583 to E. F. Barrett discloses a game wherein the use of colors is limited to lightly and darkly colored playing pieces, and lightly and darkly colored checks at the side and end margins of an otherwise conventionally checkered game board.

U.S. Pat. No. 3,532,342 to M. Simpson discloses a game comprising a checkered game board which includes a plurality of transparent checks of different primary colors, and a plurality of transparent game playing pieces of different primary colors; and is arranged so that the various combinations of the primary game board check and game playing piece colors will give rise to different binary colors when the pieces are disposed on the game board checks. Playing piece movement is generally in accordance with the rules of conventional "checkers," but playing piece jumping is restricted to situations wherein adjacent playing pieces appear in the same binary color.

U.S. Pat. No. 4,364,568 discloses a game comprising a checkered game board including differently colored and neutrally colored checks, and neutrally colored game board margins. The respective playing pieces are divided into two differently shaped groups, one for each player; and are differently colored within those groups. Jumping and bumping movement of the playing pieces which are moved alone, or in stacks in accordance with the color of the top playing piece, is restricted in part by a requirement for coincidence between the color of the playing piece, or the color of the top playing piece in a playing piece stack, and the color of the game board check or playing space to which movement is directed.

OBJECTS OF THE INVENTION

It is, accordingly, an object of this invention to provide a new and improved board game which makes ingeniously correlated, challenging, exciting and/or educational use of a variety of colors in conjunction with the game board and the game playing pieces.

It is another object of this invention to provide a board game as above which is playable in accordance with different methods of game play by adults and children, respectively, to thus provide for significant game versatility and breadth of game appeal.

It is another object of this invention to provide a board game as above which, although particularly ingenious and challenging, does incorporate certain concepts from widely known prior art board games in the nature of "checkers" to thus render the playing of the board game of the invention readily learnable without requirement for tedious study of totally unfamiliar game configurations and/or methods of play, thereby additionally providing for significant breadth of game appeal.

Another object of this invention is the provision of a board game as above comprising a game board and game playing pieces which are of relatively uncomplicated design and construction to thereby enable mass board game production at low board game unit cost.

DESCRIPTION OF THE DRAWINGS

The above and other objects and significant advantages of the board game of my invention are believed made clear by the following detailed description thereof taken in conjunction with the accompanying drawings wherein:

FIGS. 2, 3 and 4 are respectively perspective views of different representative game playing pieces configured in accordance with the teachings of my invention;

FIGS. 5, 6 and 7 are respectively perspective views of additional game playing pieces configured in accordance with the teachings of my invention for game play by children;

DETAILED DESCRIPTION OF THE INVENTION

Figure 1:
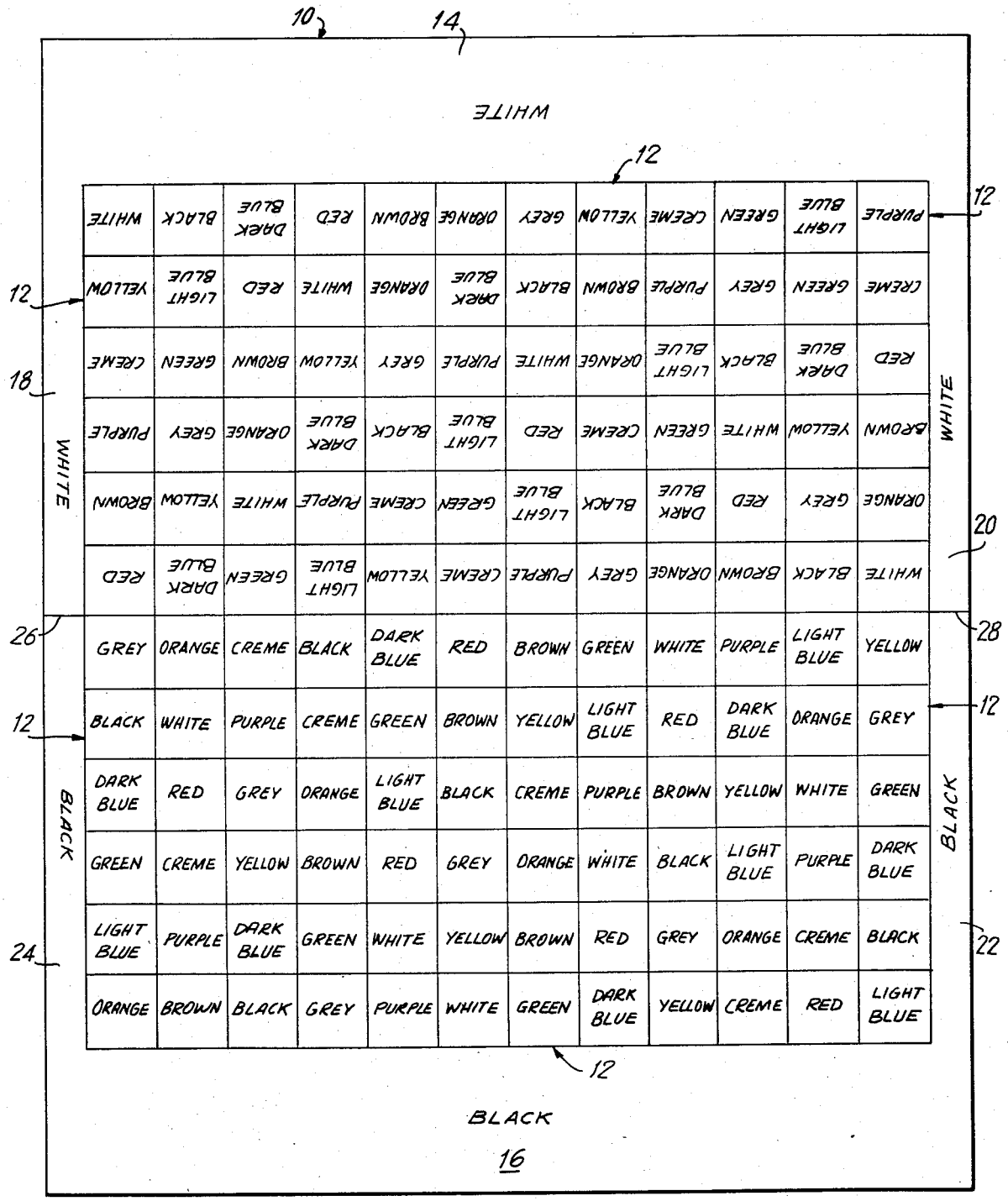
FIG. 1 is a top plan view of a game board configured in accordance with the teachings of my invention.

Referring now to FIG. 1 of the patent drawings, a game board configured in accordance with the teachings of my invention for game play by two opposing players, is indicated generally at 10; and comprises a rectangular playing field 12 bordered as shown by relatively wide end margins 14 and 16, and continguous, relatively narrow side margins 18, 20, 22 and 24, respectively.

The playing field 12 is equally divided as shown into one hundred and fourty four rectangular checks or playing spaces disposed in twelve rows of twelve playing spaces each. The playing spaces are colored in twelve different colors; and each row of twelve playing spaces, as viewed in turn between end margins 14 and 16, includes one playing space of each of those twelve colors.

The playing spaces are arranged within the playing field 12 in such manner so that no two directly adjacent playing spaces are of the same color. One of the playing space colors is used for the end margin 14 and the contiguous side margins 18 and 20; and another and different of the playing space colors is used for the end margin 16 and the contiguous side margins 22 and 24.

FIG. 1 makes clear that the playing field 12 is effectively divided by a straight line connecting the respective boundaries 26 and 28 between the side margins 18 and 24, and 20 and 22, into equal sides or halves, each of which will include seventy two checks or playing spaces, and each of which will be bordered on all exposed sides by the relevant different margin color. Thus may be seen, as described in greater detail hereinbelow, that provision is made for the positioning of the opposing game players to opposite ends of the game board 10 in accordance with the dispositions of end margins 14 and 16, respectively.

In the preferred embodiment of the board game of my invention as illustrated by the game board 10 of FIG. 1, it may be seen that the twelve colors of the playing spaces will be white, light blue, creme, grey, brown, dark blue, black, orange, purple, green, yellow and red, respectively; while the end margins 14 and side margins 18 and 20 will be white, and the end margin 16 and side margins 22 and 24 will be black. Of course, other and different colors, or shades of colors, may be used for some or all of the playing spaces and/or margins; it being noted that, in any event, white and black are to be considered "colors" within the context of this description.

The game playing pieces, which are all alike, may take any one of a wide variety of configurations in accordance with the teachings of my invention. Three representative configurations of the playing pieces are depicted in FIGS. 2, 3 and 4, respectively. The playing piece 30 of FIG. 2 is akin to a checker; the playing piece 32 of FIG. 3 comprises a cylindrical base 34 and an upstanding cylindrical body portion 36 supported therefrom; while the playing piece 38 of FIG. 4 comprises a cylindrical base 40 with an upstanding FIG. 42 which may, for example take the form of a somewhat fanciful characterization of a human figure, supported therefrom. Of course, a prerequisite for the game playing pieces is that the same be sized relative to the playing spaces of the playing field 12 of FIG. 1 so that the playing pieces may be disposed on those playing spaces within the boundaries thereof while not totally obscuring the color of the playing space. In addition, and for reasons made clear hereinbelow, the playing piece configuration is to be one which is readily adaptable to the concomitant and readily visible display of two colors.

In accordance with the teachings of my invention, there are a total of sixty game playing pieces of the nature representatively described with regard to FIGS. 2, 3 and 4. These sixty playing pieces are divided by color into groups of five like-colored playing pieces each; and six of these groups are assigned to each of the opposing game players to result in thirty game playing pieces per player. The five playing pieces of one group of one of the player's six groups are of a single color which is the same color as the margins 14, 18 and 20; and the five playing pieces of one group of the other player's six groups are of a different single color which is the same color as the margins 16, 22 and 24. The five playing pieces of each of the remaining five playing piece groups of each of the players bear both the relevant margin color and, in each instance, a different one of the ten colors remaining from the twelve colors described hereinaboe with regard to the playing spaces 12 of the game board 10. Thus, and representatively describing the respective playing piece colors in terms of the twelve colors given by way of example hereinabove, it may be understood that one player, namely the one playing from the game board end of white end margin 14, would receive five all white playing pieces, five light blue and white playing pieces, five creme and white playing pieces, five grey and white playing pieces, five brown and white playing pieces, and five dark blue and white playing pieces. The opposing player, namely the one playing from the the game board end of black end margin 16, would receive five all black playing pieces, five orange and black playing peices, five purple and black playing pieces, five green and black playing pieces, five yellow and black playing pieces, and five red and black playing pieces.

For purposes made clear hereinbelow, the five like-colored playing pieces of each of the twelve playing piece groups are numbered 1, 2, 3, 4 and 5, respectively.

Arrangement of the different color combinations on each of the multi-colored playing pieces, and playing piece numbering in all instances, is effected in the manner most compatible with playing piece configuration and virtually instant recognition. Thus, the representative playing piece 30 of FIG. 2 may, for example, simply be divided in half by the colors white and brown and have the number 1 displayed thereon as shown. The representative playing piece 32 of FIG. 3 may, for example, have the base 34 colored black, the upstanding body portion 36 colored orange, and have the number 3 displayed thereon as shown. The representative playing piece 38 of FIG. 4 may, for example, have the base 40 and legs of the FIG. 42 colored white, the upper body, head and arms of the FIG. 42 colored dark blue, and have the number 5 displayed thereon as shown. Single color playing pieces would be colored accordingly.

Further included in the playing pieces of the game of my invention are a pair of dice-like cubes as depicted at 44 and 46 in FIGS. 5 and 6, respectively. Each of the cubes 44 and 46 has six differently colored sides, for a total of twelve colors overall, to thus correspond to the total number of colors of interest as discussed hereinabove. Thus, in the given colors example, cube 44 of FIG. 5 (which is depicted twice to clearly illustrate all of the sides thereof) would have sides colored white, light blue, creme, grey, brown, and dark blue; while cube 46 of FIG. 6 (also depicted twice for the stated purposes) would have sides colored black, orange, purple, green, yellow, and red. Six marker rings in groups of three each are shown at 48 and 50 in FIG. 7. The marker rings of each of these groups are colored in accordance with the respective colors of the end margins 14 and 16. Thus, in the given colors example, marker rings 48 would be white, and marker rings 50 would be black.

In accordance with the teachings of my invention, there are two distinct methods of play for the board game thereof; one of which particularly adapts the game for play by two opposing adults, and the other of which particularly adapts the game for play by two or more opposing children. Use of the cubes 44 and 46 of FIG. 5 or the marker rings 48 and 50 is not required for the adult method of game play.

Figure 8:
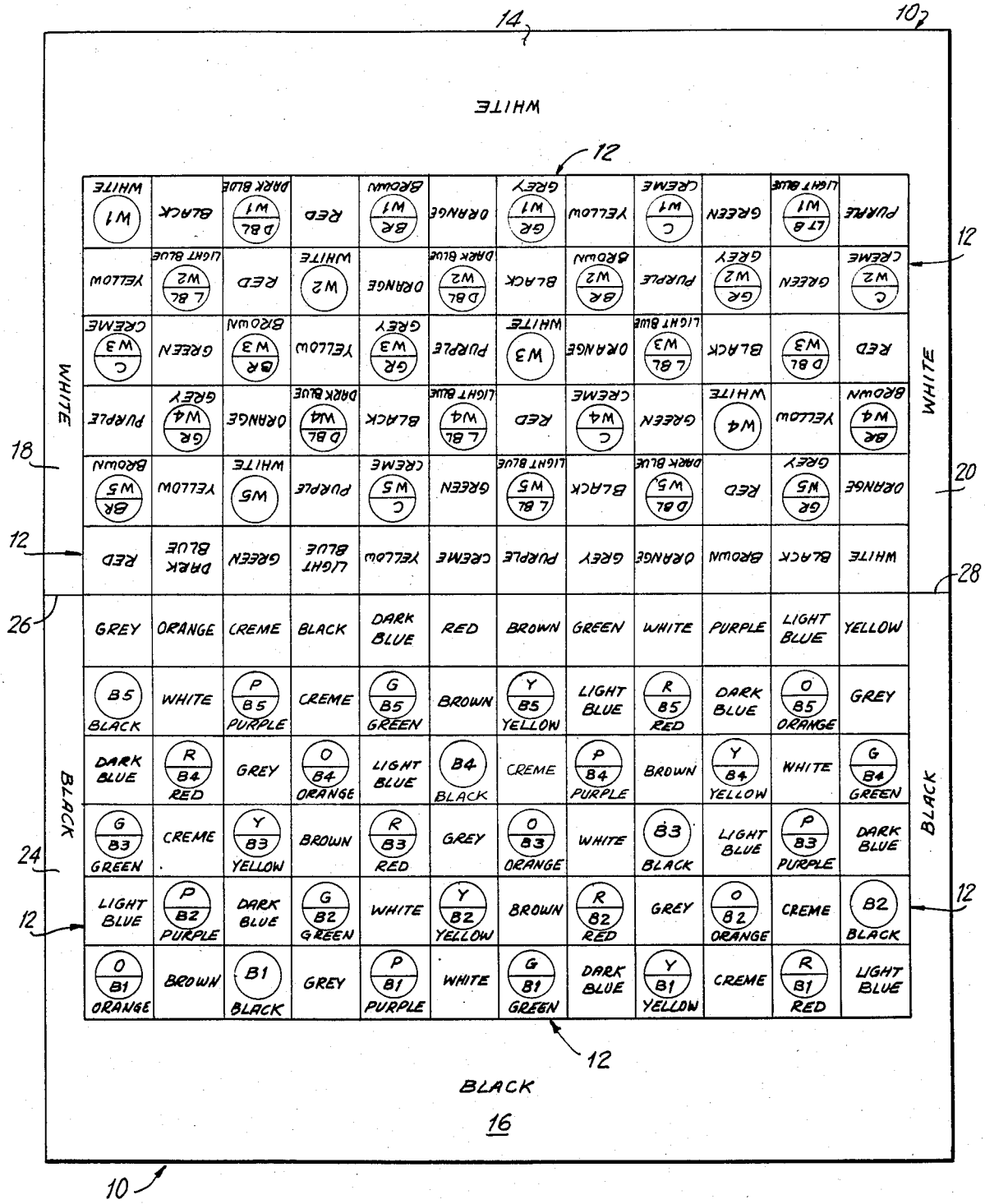
FIG. 8 is a top plan view of the game board of FIG. 1 with the representative playing pieces of FIG. 2 disposed thereon at the beginning of adult game play.

For adult play in accordance with the game board and playing piece descriptions provided hereinabove, and in accordance with the given colors example for the same, it may be seen that FIG. 8 depicts the initial dispositions by the opposing players of their respective thirty playing piece groups on the playing spaces of the checkered playing field 12 of the game board 10. As illustrated, the player playing from the white end margin 14 end of the game board 10 will intially dispose his or her playing pieces on alternate playing spaces in accordance with coincidence between playing piece color and number and playing space color and row number as counted from that player's position. Thus, for example, it will be seen that that the white playing piece numbered 1 will be initially disposed in the white playing space in the first playing space row relative to the white end margin 14; the brown and white playing piece numbered 2 will be initially disposed in the brown playing space in the second playing space row; the dark blue and white playing piece numbered 3 will be initailly disposed in the dark blue playing space in the third playing space row; the creme and white playing piece numbered 4 will be initially disposed in the creme playing space in the fourth playing space row; and the grey and white playing piece numbered 5 will be initially disposed in the grey playing space in the fifth playing space row. In like manner, the player playing from the black end margin 16 end of the game board 10 will initially dispose his or her playing pieces on alternate playing spaces in accordance with the same color and number coincidence. Thus, for example, it will be seen that the red and black playing piece numbered 1 will be initially disposed in the red playing space in the first playing space row as seen from the black end margin 16; the orange and black playing piece numbered 2 will be initially disposed in the orange playing space in the second playing space row; the purple and black playing piece numbered 3 will be initially disposed in the purple playing space in the third playing space row; the green and black playing piece numbered 4 will be initially disposed in the green playing space in the fourth palying space row; while the black playing piece numbered 5 will be initially disposed in the black playing space in the fifth playing space row.

In accordance with the method of game play for adults, the nature of movement permitted for the respective playing pieces on the playing field 12 is dictated in part by playing piece color characteristics. More specifically, the single or solid color playing pieces, namely the five all white playing pieces and the five all black playing pieces, are moveable in the manner of "Kings" in the widely known game of "checkers" from playing space to adjacent unoccupied playing space on a one move at a time basis (except for multiple jumping as described hereinbelow) in any direction, e.g. to the front, back, side or diagonally. To this effect, these playing pieces may be referred to as the "King Pieces" and, in the given colors example, white and black may be referred to as the "Kings of Colors."

The multi-colored playing pieces, which encompass all of the remaining playing pieces of each of the players, are moveable in the manner of the single playing pieces in the game of "checkers" from playing space to adjacent unoccupied playing space on a one move at a time basis (again except for multiple jumping); but only to the front or the side, and not to the back or diagonally. Too, once one of these playing pieces is moved to the side, all further sidewards movement of that playing piece is restricted to that same side. Thus, for example, if the initial sidewards movement of the green and black playing piece numbered 5 in the fifth row of the black margined end of the game board 10 as seen in FIG. 8 were to the right as seen from that game board end into the adjacent unoccupied brown playing space, all further sidewards movement of that playing piece would have to be in that same direction. In like manner, if the initial sidewards movement of the grey and white playing piece numbered 2 in the second row of the white margined end of the game board 10 as seen in FIG.8 were to the left into the adjacent unoccupied green playing space, all further sidewards movement of that playing piece would have to be in that same direction.

Of course, the initial move of a multi-colored playing piece need not necessarily be to the side—it could be to the front—but once a sidewards move is made, the rule then applies and all further sidewards moves of that playing piece must be in the same direction. Verification of adherence to this rule by both the moving and opposing player is greatly facilitated by the number on each of the multi-colored playing pieces, since that number taken in conjunction with the colors of the playing piece of interest provides indicia of the particular one of the five like, multi-colored playing pieces in terms of the side to which the same has first been moved. No such restrictions apply to sidewards movement of the solid colored "King Pieces."

Playing piece jumping as in "Checkers" by a playing piece from a playing space over an opponent's playing piece in an adjacent playing space to an aligned unoccupied playing space adjacent to the latter is permitted, and in fact encouraged; but is again restricted in accordance with the color characteristics of the playing piece doing the jumping. The solid colored playing pieces or "King Pieces" are permitted to jump an opponent's playing piece in any direction, e.g. to the front, back, side or diagonally; while the multi-colored playing pieces are permitted to jump the opponent's playing pieces only to the front, side or back. Within the confines of these restrictions, all playing pieces may be jumped by all other playing pieces without regard for playing piece color characteristics; and the restrictions on subsequent sidewards movement of the multi-colored playing pieces do not apply to jumping by those playing pieces. Multiple jumping, e.g. the consecutive jumping by the same playing piece of two or more properly aligned and spaced playing pieces of the opponent, as in "Checkers," is permitted; but only in accordance with the restrictions set forth hereinabove.

Once a playing piece is "jumped" it is removed from the playing field 12 by the player who accomplished the feat, and is positioned for display and ready reference by that player in his or her end margin which is purposefully made relatively wide to that effect. In any situation wherein jumping of a playing piece becomes possible, the same must be accomplished and there is no discretion or alternative penalty as in "Checkers" in the nature of the removal from the playing field 12 of the jump-capable playing piece in question for failure to jump.

Playing piece movement in the adult method of game play is on an alternating turn basis, again as in "Checkers;" and any mutually satisfactory method may be used to determine which player moves first.

The major objective of the board game of my invention in accordance with the adult method of game play is for each player to move as many of his or her playing pieces as possible into correspondingly colored playing spaces on the opponent's side of the playing field 12, while jumping as many of the opponent's playing pieces as possible to prevent the movement thereof into correspondingly colored playing spaces on his or her side of the playing field; it being noted that the respective "sides" of the playing field 12 are constituted in each instance by the first five playing space rows as discussed hereinabove, thereby leaving the middle two playing space rows 52 and 54 of the playing field 12 as neutral ground. These "sides" are hereinafter referred to as the "white side" and the "black side," respectively, in accordance with the color of the respective end and side margins which surround the same.

Points are awarded to each player for each of his or her playing pieces which are succesfully moved into correspondingly colored playing spaces on the opponent's side of the playing field 12; with five points being awarded for each solid colored playing piece or "King Piece" so moved, and one point being awarded for each multi-colored piece so moved. Once a playing piece has been so moved, it becomes "safe" and can no longer be jumped by any opponent's playing piece under any circumstances. The winner of the game is the player with the highest point total at game completion.

By way of example to more clearly illustrate the adult method of play of the game of my invention, and referring again to FIG. 8, it may be seen that the player from the white side of the playing field 12 scores five points by successfully moving the white playing piece or "King Piece" numbered 2 from the second playing space row on the white side of the playing filed 12 to the white playing space in the third playing space row on the black side of the playing field; scores one point for successfully moving the grey and white playing piece numbered 5 from the fifth playing space row on the white side of the playing field 12 to the grey space in the first playing space row on the black side of the playing field; and scores one point for successfully moving the light blue and white playing piece numbered 1 from the first playing space row on the white side of the playing field 12 to the light blue playing space in the first playing space row on the black side of the playing field. In like manner, the player from the black side of the playing field 12 scores five points by successfully moving the black playing piece or "King Piece" numbered 1 from the first playing space row on the black side of the playing field 12 to the black playing space in the first playing row on the white side of the playing field; scores one point for successfully moving the yellow and black playing piece numbered 4 from the fourth playing space row on the black side of the playing field 12 to the yellow playing space in the second playing space row on the white side of the playing field; and scores one point for successfully moving the purple and black playing piece numbered 3 from the third playing space on the black side of the playing field 12 to the purple playing space in the third playing space row on the white side of the playing field. Of course, "successfully moving" includes the necessity for so moving the playing piece in question as to avoid the same being "jumped" by the opponent and removed from the playing field 12 before the playing piece has completed its moves to its intended, point-scoring destination; and, in the case of the multi-colored playing pieces, further requires the determination prior to the initial sidewards playing piece move as to which of the two available directions (except for the multi-colored playing pieces disposed in playing spaces bordered directly by the white side margins 20 and 22 or the black side margins 18 and 24) for that move will present the greatest probability of success as above in view of the disposition of the opponent's playing pieces at that point in game-playing time. At least one sidewards movement is required for success as above.

Figure 9:
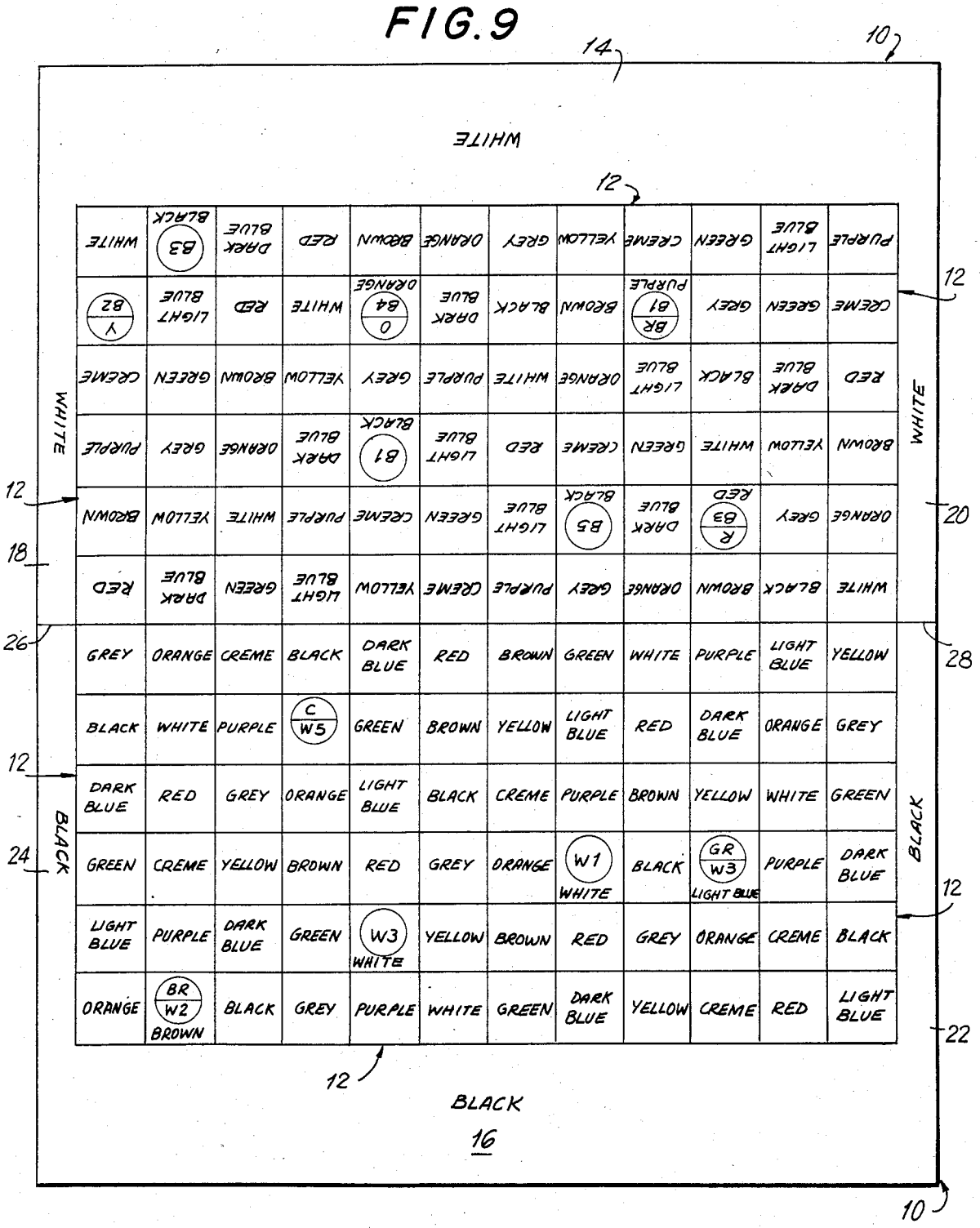
FIG. 9 is a top plan view of the game board of FIG. 1 illustrating a representative disposition of the remaining playing pieces at the conclusion of adult game play.

A representative disposition of the remaining playing pieces on the playing field 12 at the completion of a game is illustrated by FIG. 9 wherein it may now readily be seen that the score would be eighteen to twelve in favor of the player from the black side of the playing field. This Figure additionally makes clear that there may be playing pieces remaining on the playing field 12 at game end which cannot be properly moved any further to score points, thereby rendering further play of the game unnecessary with regard to the determination of a winner. More specifically, and assuming the initial sidewards move of the grey and white playing piece numbered 3 from the third playing piece row of the white side of the playing field 12 to have been to the left as seen from that playing field side (this would, of course, be to the right as seen from the black playing field side), it will be clear that the depicted positioning of that playing piece in the light blue playing space in the third playing space row on the black side of the playing field would render impossible any further moves of that playing piece into a green playing space on the black side of the playing field for scoring purposes. In like manner, and assuming the initial sidewards movement of the brown and black playing piece numbered 1 from the first playing space row of the black side of the playing field 12 to have been to the right as seen from that playing field side (thus to the left as seen from the white playing field side), it will be clear that the depicted location of that playing piece in the purple playing space in the second palying space row on the white side of the playing field would render impossible any further moves by that playing piece into a brown playing space on the white side of the field for scoring purposes. Alternatively, the game may end with one player have scored sufficient points as described to render it impossible for the other player to equal that point total even if he she could be successful in moving all of his or her non-scoring playing pieces into scoring position. To avoid undue complexity of illustration, all of the remaining "jumped" playing pieces of the game of FIG. 9 which would normally be positioned for ready reference by both players on the respective black and white end margins 14 and 16 are not shown therein.

If desired, the adult method of game play can be made more difficult by requiring that points can only be scored by movement of a playing piece to a correspondingly colored *and* numbered playing piece on the opponent's side of the playing field 12. Thus, for example, a point could only be scored by the orange and black playing piece numbered 3 from the third playing piece row on the black side of the playing field 12 by successfully moving that playing piece to the orange playing space in the *third* playing space row on the white side of the playing field. In like manner, five points could only be scored by the all white playing piece or "King Piece" numbered 1 from the first playing piece row on the white side of the playing field 12 by successfully moving the same to the white playing space in the *first* playing space row on the black side of the playing field.

In accordance with the method of play of the game of my invention for children, the two opposing players are again placed at opposite ends of the game board 10, with one child playing the white side of the playing field 12 and the opposing child playing the black side of the playing field. The child playing the white playing field side would receive the same thirty playing pieces as described hereinabove for the adult white side player; while the child playing the black side of the playing field would receive the same thirty playing pieces as described hereinabove for the adult black side player. In addition, the child playing the white side would receive the cube 44 of FIG. 5 which has white, light blue, creme, grey, brown and dark blue sides, respectively, and the three white marker rings 48 of FIG. 7; while the child playing the black side would additionally receive the cube 46 of FIG. 6 which has black, orange, green, purple, yellow and red sides, respectively, and the three black marker rings 50 of FIG. 7.

For game play by children, none of the playing pieces are initially disposed on the playing field 12 as in adult game play, but rather, are disposed on the relevant, relatively wide end margin in each instance. Thus, the playing pieces of the child playing the white side of the playing field 12 would initially dispose all of his or her thirty playing pieces on white end margin 14; while the child playing the black side of the playing field 12 would initially dispose all of his or her thirty playing pieces on the black end margin I6.

Following determination by any mutually acceptable means as to which child plays first, that child tosses his or her cube to land on the playing field 12, and both players note the color of the side of the cube which faces upwardly when the cube stops. Thus, and assuming the child playing the black side of the playing field 12 to have played first, and the cube 46 to have stopped with the red cube side facing upwardly, that child chooses any one of his or her five red and black playing pieces and places the same on a red playing space in any of the first five playing space rows of the black side of the playing field. As this occurs, the child playing the white side of the playing field 12 places one of the white marker rings 48 in the red playing space of the neutral playing space row on the white side of the playing field as a reminder that one "red" throw has been made by the child playing the black side.

The turn then shifts to the child playing the white side of the playing field 12 who then tosses his or her cube 46 as above; and, assuming that cube to have come to rest with the light blue side facing upwardly, places any one of his or her light blue and white playing pieces on a light blue playing space in any of the first five playing space rows on the white side of the playing field 12. As this occurs, the child playing the black side of the playing field places one of the black marker rings 50 in the light blue playing space of the neutral playing space row on the black side of the playing field as a reminder that one "light blue" throw has been made by the child playing the white side. Of course, a "black" throw of cube 46 by the child playing the black side of the playing field 12 results in the placement as described of an all black playing piece on a black playing space in an appropriate playing space row, and corresponding white marker ring placement by the opponent in the black playing space of the neutral playing space row on the white side of the playing field 12; while a "white" cube throw by the child playing the white side of the playing field 12 results in the placement as described of an all white playing piece on a white playing space in an appropriate playing space row, and corresponding black marker ring placement by his or her opponent in the white playing space of the neutral playing space row on the black side of the playing field 12.

The marker rings are moved, or stacked, as required to always indicate the color of the most recent cube throw of the opponent. Thus, and in the given examples, if the cube throw following the "red" cube throw of the child playing the black side of the playing field 12 is "orange" to result in the placement of an orange and black playing piece by that player as described on the black side of the playing field, the child playing the white side of the playing field would move the white marker ring 48 from the red to the orange playing space in the neutral playing space row of the white playing field side. Alternatively, if the cube throw following the "light blue" throw of the child playing the white side of the playing field 12 is again "light blue" to result in the placement of another light blue and white playing piece by that player as described on the white side of the playing field, the child playing the black side of the playing field would stack a second black marker ring 48 atop the the black marker ring already disposed on the light blue playing space in the neutral playing row on the black side of the playing field.

In any instance wherein a child throws the same cube side color on three consecutive turns, as will be clearly indicated to both players by the appropriately stacked marker rings in accordance with the above, that child loses a turn—in effect the last throw—and one of that child's playing pieces of the color in question is removed from the playing field 12 and returned to the relevant end margin. At this juncture, the three stacked marker rings are removed from the relevant playing space in the neutral playing space row on the opponent's side of the playing field 12, and there would be no further playing piece removal penalty in the event that the same color is again thrown on the next turn of the penalized player.

In any instance wherein a child throws a color which has already been exhausted, e.g. all of the five spaces of that color on his or her side of the playing field 12 have already been occupied by like-colored playing pieces, the turn simply shifts to the opponent thus in essence resulting in the loss of a turn. For example, if the child playing the white side of the playing field 12 has already been succesful in placing all five of his or her creme and white playing pieces in the five creme colored playing spaces on the white side of the playing field 12, any subsequent "creme" throws of cube 44 would simply result in the turn shifting to the child playing the black side of the playing field.

Game play by children continues as described on an alternating turn basis until one child is successful in placing all of his or her playing pieces in the like-colored playing spaces on his or side of the playing field 12 to become the game winner.

If desired, the method of game play for children can be made somewhat more demanding by requiring placement of the playing pieces in each instance not only in the like colored palying spaces of the playing space rows, but also in the like numbered of those playing space rows as counted by the child from his or her end of the playing field 12. Thus, for example, placement of the light blue and white playing piece numbered 3 would only be proper in the light blue playing space in the third playing space row of the white side of the playing field 12; while placement of the orange and black playing piece numbered 5 would only be proper in the orange playing space in the fifth playing space row of the black side of the playing field 12. An additional requirement could be that the playing pieces be placed by the children in ascending numerical order on the playing field 12; and removed from the playing field as described,in the event of three consecutive cube throws of the same color, in descending numerical order.

Fabrication of the respective components of the board game of my invention may obviously be readily and inexpensively accomplished from any appropriate, readily available materials in the nature, for example, of plastics, cardboard and/or wood; and the game board 10 may, of course, be made foldable in the middle By all of the above is believed made clear that a great deal of thoughtful strategy is required for adults to successfully play the game of my invention in that each playing piece move must be carefully deliberated beforehand in terms of best positioning that playing piece to jump opponent's playing pieces, best positioning that playing piece to avoid jumping by the opponent's playing pieces, and best positioning that playing piece to successfully arrive at its intended, like-colored and point-scoring playing space destination at the opponent's side of the playing field 12. Thus is made clear that challenge and excitement are an integral part of adult game play.

Regarding game play by children, it will be clear that the game of my invention will effectively educate with regard to color recognition, color distinction and color correlation; all of which are, of course, required for proper playing piece placement on, and removal from, the playing field 12 in accordance with the respective playing space colors, playing piece colors, cube side colors, and marker ring colors. In addition, and in instances wherein playing piece placement is required in numerical order in accordance with playing space row number, recognition and understanding of numbers are also taught. Thus is made clear that challenge, excitment and education are integral parts of game play by children.

Various changes may, of course, be made in the herein disclosed embodiments of my invention without departing from the spirit and scope of that invention as defined by the appended claims.

What is claimed is:

1. In a board game which includes a game board comprising a generally rectangular playing field which is divided into a plurality of generally parallel rows of equal nuabers of generally rectangular playing spaces, the improvements comprising, each of said playing space rows comprising a plurality of differently colored playing spaces, a plurality or differently colored playing pieces which are positionable on said playing spaces and moveable therebetween attendant game play, each of said playing pieces bearing the color of at least one of said playing spaces, and some, only, of said playing pieces bearing the different colors of at least two of said playing spaces, and wherein no two playing spaces of any one of said playing space rows are of the same color.

2. In a board game which includes a game board comprising a generally rectangular playing field which is divided into a plurality of generally parallel rows of equal numbers of generally rectangular playing spaces, the improvements comprising, each of said playing space rows comprising a plurality of differently colored playing spaces, a plurality of differently colored playing pieces which are positionable on said playing spaces and moveable therebetween attendant game play, each of said playing pieces bearing the color of at least one of said playing spaces, and some, only, of said playing pieces bearing the different colors of at least two of said playing spaces, a first cube having a plurality of sides, each of which bears the different color of a different one of the playing spaces of a playing space row, and a second cube having a plurality of sides, each of which bears the different color of a different one of other of the playing spaces of the same playing space row, a first plurality of marker rings bearing the color of one of said playing spaces, and a second plurality of marker rings bearing the different color of a different one of said playing spaces.

3. In a board game which includes a game board comprising a generally rectangular playing field which is divided into a plurality of generally parallel rows of equal numbers of generally rectangular playing spaces, the improvements comprising, each of said playing space rows comprising a plurality of differently color playing spaces, a plurality of differently colored playing pieces which are positionable on said playing spaces and moveable therebetween attendant game play, each of said playing pieces bearing the color of at least one of said playing spaces, and some, only, of said playing pieces bearing the different colors of at least two of said playing spaces, said playing field being dividable by a common, generally central line into opposite sides, with each of said playing field sides having the same number of playing space rows, said playing pieces being dividable into a plurality of groups of equal numbers of like-colored playing pieces, with the playing pieces of a first plurality of said playing piece groups being positionable at the commencement of game play on the playing spaces of one of said playing field sides in accordance with coincidence between the color of the playing space and a color of the playing piece, and the playing pieces of another plurality of a like number of groups of playing pieces being positionable at the commencement of game play on the playing spaces of the other of said playing field sides in accordance with coincidence between the color of the playing space and a color of the playing piece, said playing pieces of said first plurality of playing piece groups being numbered in accordance with the playing space row of the playing space field upon which the same are positionable, and the playing pieces of said another plurality of playing piece groups being numbered in accordance with the playing space row of the playing field upon which the same are positionable.

4. In a board game which includes a game board comprising a generally rectangular playing field which is divided into a plurality of generally parallel rows of equal numbers of generally rectangular playing spaces, the improvements comprising, each of said playing space rows comprising a plurality of differently colored playing spaces, a plurality of differently colored playing pieces which are positionable on said playing spaces and moveable therebetween attendant game play, each of said playing pieces bearing the color of at least one of said playing spaces, and some, only, of said playing pieces bearing the different colors of at least two of said playing spaces, said playing field being dividable by a common, generally central line into opposite sides, with each of said playing field sides having the same number of playing space rows, said playing pieces being dividable into a plurality of groups of equal numbers of like-colored playing pieces, with the playing pieces of a first plurality of said playing pieces groups being positionable at the commencement of game play on the playing spaces of one of said playing field sides in accordance with coincidence between the color of the playing space and a color of the playing piece, and the playing pieces of another plurality of a like number of groups of playing pieces being positionable at the commencement of game play on the playing spaces of the other of said playing field sides in accordance with coincidence between the color of the playing space and a color of the playing piece, and wherein each of said playing piece groups comprises five playing pieces, and there is a total of twelve such playing piece groups.

5. In a board game which includes a game board comprising a generally rectangular playing field which is divided into a plurality of generally parallel rows of equal numbers of generally rectangular playing spaces, the improvements comprising, each of said playing space rows comprising a plurality of differently colored playing spaces, a plurality of differently colored playing pieces which are positionable on said playing spaces and moveable therebetween attendant game play, each of said playing pieces bearing the color of at least one of said playing spaces, and some, only, of said playing pieces bearing the different colors of at least two of said playing spaces, said playing field being dividable by a common, generally central line into oppoiste sides, with each of said playing field sides having the same number of playing space rows, said playing pieces being dividable into a plurality of groups of equal numbers of like-colored playing pieces, with the playing pieces of a first plurality of said playing piece groups being positionable at the commencement of game play on the playing spaces of one of said playing field sides in accordance with coincidence between the color of the playing space and a color of the playing piece, and the playing pieces of another plurality of a like number of groups of playing pieces being positionable at the commencement of game play on the playing spaces of the other of said playing field sides in accordance with coincidence between the color of the playing space and a color of the playing piece, and wherein the colors of said playing spaces of each of said playing space rows are white, black, brown, orange, grey, purple, creme, yellow, light blue, green, dark blue, and red, respectively.

6. In a board game which includes a game board comprising a generally rectangular playing field which is divided into a plurality of generally parallel rows of equal numbers of generally rectangular playing spaces, the improvements comprising, each of said playing space rows comprising a plurality of differently colored playing spaces, a plurality of differently colored playing pieces which are positionable on said playing spaces and moveable therebetween attendant game play, each of said playing pieces bearing the color of at least one of said playing spaces, and some, only, of said playing pieces bearing the different colors of at least two of said playing spaces, said playing field being dividable by a common, generally central line into opposite sides, with each of said playing field sides having the same number of playing space rows, said playing pieces being dividable into a plurality of groups of equal numbers of like-colored playing pieces, with the playing pieces of a first plurality of said playing piece groups being positionable at the commencement of game play on the playing spaces of one of said playing field sides in accordance with coincidence between the color of the playing space and a color of the playing piece, and the playing pieces of another plurality of a like number of groups of playing pieces being positionable at the commencement of game play on the playing spaces of the other of said playing field sides in accordance with coincidence between the color of the playing space and a color of the playing piece, and wherein the colors of said playing pieces are white, light blue and white, creme and white, grey and white, brown and white, dark blue and white, black, orange and black, purple and black, green and black, yellow and black, and red and black, respectively.

7. In a board game which includes a game board comprising a generally rectangular playing field which is divided into a plurality of generally parallel rows of equal numbers of generally rectangular playing spaces, the improvements comprising, each of said playing space rows comprising a plurality of differently colored playing spaces, there being playing spaces of at least three different colors in each of said playing space rows, a plurality of differently colored playing pieces which are positionable on said playing spaces and moveable therebetween attendant game play, each of said playing pieces bearing the color of at least one of said playing spaces, and some of said playing pieces bearing the different colors of at least two of said playing spaces and wherein some of said playing pieces bear only the color of one of the playing spaces of a playing space row, and some other of said playing pieces bear only the different color of another one of the playing spaces of that same playing space row.

8. In a board game as in claim 7 wherein, each of said playing space rows comprises playing spaces of the same plurality of different colors.

9. In a board game as in claim 7 further comprising, a first cube having a plurality of sides, each of which bears the different color of a different one of the playing spaces of a playing space row, and a second cube having a plurality of sides, each of which bears the different color of a different one of other of the playing spaces of the same playing space row.

10. In a board game as in claim 7 wherein, said playing pieces are positionable at the commencement of game play on said playing spaces in accordance with coincidence between the color of the playing space and a color of the playing piece.

11. In a board game as in claim 7 wherein, said playing field is dividable by a common, generally central line into opposite sides, with each of said playing field sides having the same number of playing space rows.

12. In a board game as in claim 11 wherein, said game board further comprises, a first margin bordering a first of said playing field sides and bearing the color of one of said playing spaces, and a second margin bordering the other of said playing field sides and bearing the color of a different one of said playing spaces.

13. In a board game as in claim 11 wherein, said playing pieces are dividable into a plurality of groups of equal numbers of like-colored playing pieces, with the playing pieces of a first plurality of said playing piece groups being positionable at the commencement of game play on the playing spaces of one of said playing field sides in accordance with coincidence between the color of the playing space and a color of the playing piece, and the playing pieces of another plurality of a like number of groups of playing pieces being positionable at the commencement of game play on the playing spaces of the other of said playing field sides in accordance with coincidence between the color of the playing space and a color of the playing piece.

14. In a board game as in claim 13 wherein, there are six rows of playing spaces on each of said playing field sides, and there are twelve playing spaces in each of said playing space rows.

* * * * *